United States Patent [19]

Brockett, III

[11] B 3,988,843

[45] Nov. 2, 1976

[54] MINING TRANSITION CHAMBER

[75] Inventor: Frank Howard Brockett, III, Bellevue, Wash.

[73] Assignee: The International Nickel Company, Inc., New York, N.Y.

[22] Filed: Dec. 11, 1974

[21] Appl. No.: 531,753

[44] Published under the second Trial Voluntary Protest Program on March 2, 1976 as document No. B 531,753.

[52] U.S. Cl. ..... 37/57; 37/58; 37/DIG. 8; 302/15

[51] Int. Cl.[2] ..... E02F 3/92

[58] Field of Search ..... 302/15, 58; 37/58, 57, 37/55, DIG. 8; 15/1.7, 415, 420, 422; 299/8, 9

[56] References Cited

UNITED STATES PATENTS

| | | | |
|---|---|---|---|
| 646,490 | 4/1900 | Deery | 302/58 X |
| 867,492 | 10/1907 | Frayer | 37/58 |
| 2,889,779 | 6/1959 | Hofer | 37/58 X |
| 3,329,287 | 7/1967 | De Koning | 37/58 |
| 3,504,943 | 4/1970 | Steele et al. | 299/8 |
| 3,802,740 | 4/1974 | Sullivan | 37/DIG. 8 |

*Primary Examiner*—Clifford D. Crowder
*Attorney, Agent, or Firm*—George N. Ziegler; Ewan C. MacQueen

[57] ABSTRACT

Improvement in undersea mining apparatus, of the kind wherein a hydraulic suction conduit riser is towed from a forwardly moving surface ship while a mixture of liquids and sea-floor solids (such as sea water and manganese nodules) is gathered at the deep sea floor and transported to the sea surface in a liquid-solids flow pumped up through the riser, comprises liquid-solids flow transition chamber that is connected to riser by an intermediate conveyance duct and towed along the undersea floor to gather and transmit solids from undersea floor to riser. Transition chamber has three mutually communicating openings: a forward-facing entrance for gathering sea floor solids, a rearward-facing entrance for admitting a hydraulically induced flow of sea water and a forwardly upward-facing exit port joined with the conveyance duct to direct transmission of liquid-solids mixture flow from chamber into conveyance duct. Chamber can be mounted as a tail pipe suspended from framework of vehicle having runners for sliding along undersea floor with forward entrance held near floorline.

10 Claims, 5 Drawing Figures

MINING TRANSITION CHAMBER

The present invention relates to obtaining solid minerals and more particularly to underwater mining.

Heretofore, desirable mineral aggregates have been found underwater, and many metallurgic and economic studies have indicated that substantial amounts of useful minerals are present as solid mineral aggregates, e.g., manganese nodules, on deep ocean floors. In many instances the aggregates are found dispersed over wide areas of the sea floor and although upward transport apparatus, such as suction conduits, has been devised for raising ore aggregates up through the sea to a mining ship, there are needs for improved means to effect the transition from sea floor to transport apparatus and, desirably, to also accomplish some concentration of the dispersed, and desired, aggregates for efficient transportation up to the sea surface. Problems of providing ocean floor mining apparatus are made particularly difficult by the remoteness of the operation and the vastness of the ocean floor area and also by lack of precise knowledge of the features of the terrain that will be encountered in a specific operation, albeit some information obtained by geologic sampling and undersea television. Thus, ocean mining apparatus must sustain happenstance encounter against hard unyielding obstructions, or with very liquid soft areas, or with thick viscous mud and sediment material that tends to clog conduits and passageways. And solid materials may be encountered in forms of undesirably fine particles or practically untransportable large lumps.

There has now been discovered an undersea mining transition chamber for accomplishing transition of, and in effect injecting, sea floor minerals into a flowing hydraulic transport stream of water or other transport fluid.

It is an object of the invention to provide a mining transit apparatus effective for separating solid minerals from deep ocean floors and introducing the minerals into the flow of a hydraulic suction conduit.

Other objects and advantages of the invention will become apparent from the following description taken in conjunction with the accompanying drawing wherein.

Briefly, the present invention provides undersea mining apparatus having a special hydraulic flow transition chamber, referred to at some places hereinafter as a tail pipe, joined to a hydraulic suction conduit. The chamber, which effects a solids-liquids flow transition has two entrances, one for water and the other for solids, possibly with some water, and an exit port for transmitting a mixture of solids and water to the conduit. The conduit can comprise a transport riser and a conveyance duct, both being adapted for holding a hydraulic suction flow of solids and liquids, which can be induced by pumps on a riser or on a ship or platform. The conveyance duct and the chamber can be mounted on an undersea vehicle adapted for being moved in a forward direction, e.g., by towing, along the undersea floor. Advantageously, the chamber is mounted as a tail pipe at the aft of an undersea floor vehicle with the water entrance facing aft and the solids entrance facing forward and supported with the bottom of the solids entrance at the sea floorline by a framework mounted on sliding runners. It is understood that many of the sea bottom areas that are of particular interest herein are largely covered with soft fluid-like sedimentary material, e.g., silt, and have a relatively firm floor beneath the soft material. For use on such areas, the bottom of the tail pipe entrance can be disposed at or above the floorline by having the tail pipe supported from a framework mounted on sliding runners adapted to sink into the soft material and slide on the surface of the more firm material (the sea floor) and with the framework adapted in correlation with the runners and other components of the vehicle, to hold the entrance bottom at least as high as the floorline. Supporting the solids entrance at, or a small height above and not below, the floorline is an important good feature that aids in avoiding plowing up the subfloor material and avoiding overloading or clogging the pipe, conduit or riser with excessive amounts of subfloor solids and also avoids excessive environmental disturbance.

For purposes of giving those skilled in the art a better understanding of the apparatus and use and special benefits of the invention, the following description of an illustrative advantageous embodiment is given in conjunction with the accompanying drawing.

Figure 1:
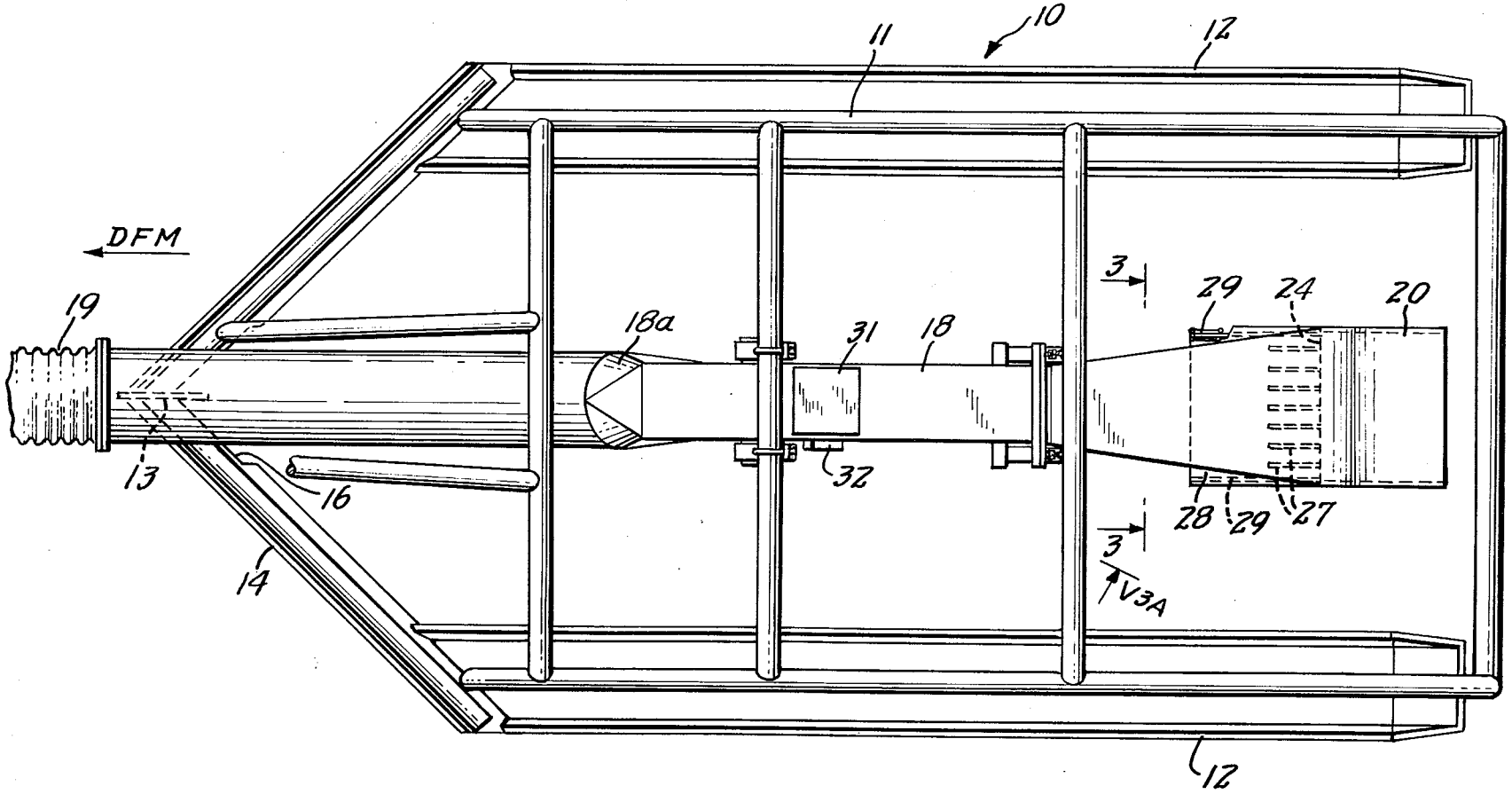
FIG. 1 is a plan view of an undersea mining vehicle having mounted thereon mining transit apparatus of the invention.
Figure 2:
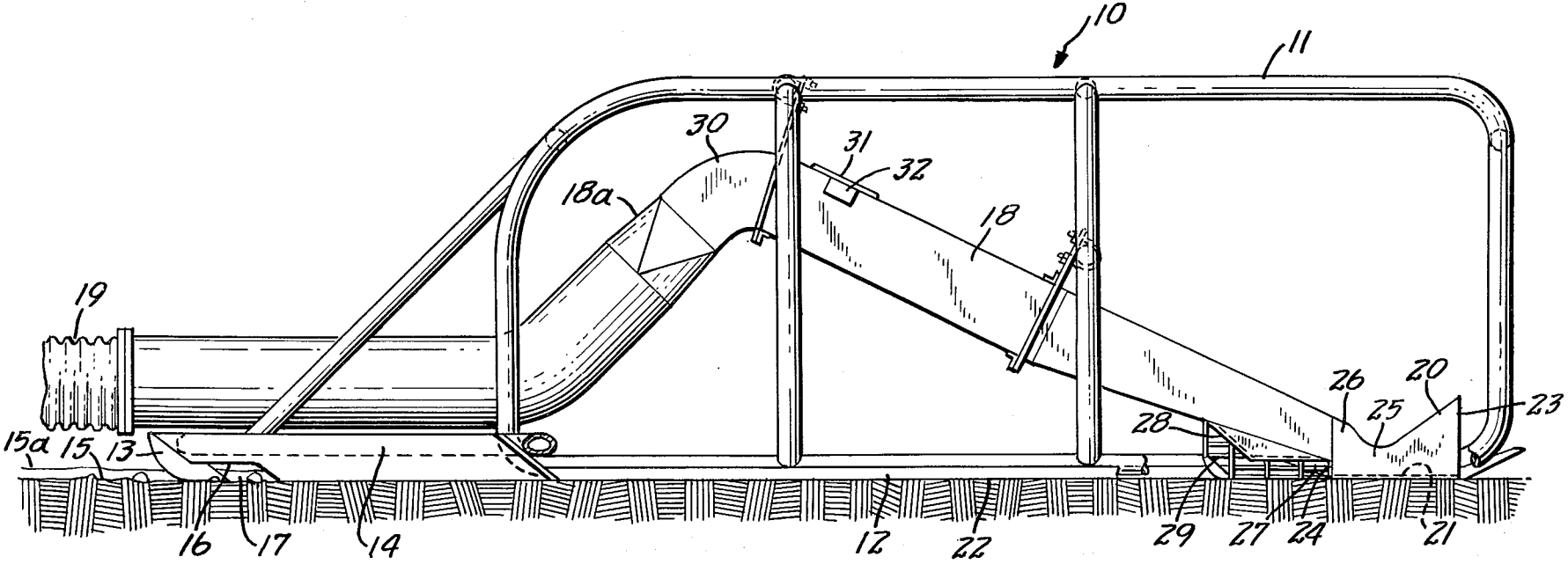
FIG. 2 is a side view of the vehicle and apparatus of FIG. 1.
Figure 3:
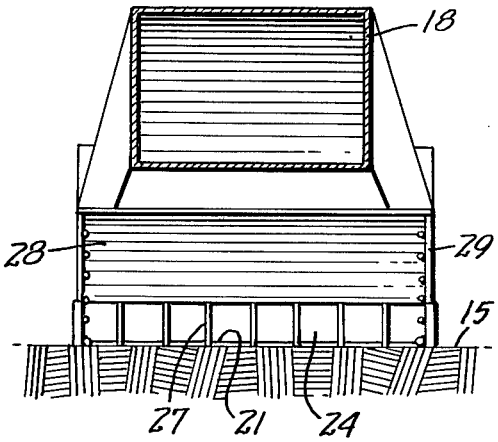
FIG. 3 is a view, on an enlarged scale, of a vertical cross section on line 3—3 of FIG. 2.
Figure 3A:
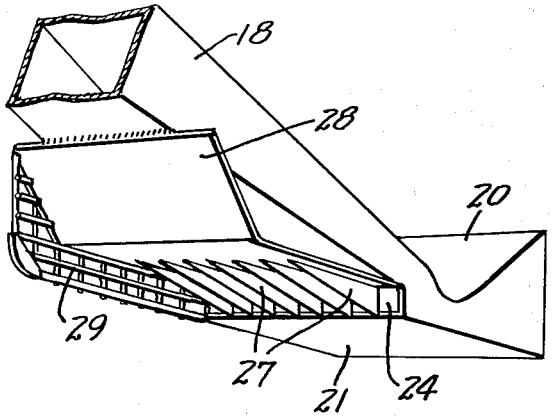
FIG. 3A is a perspective illustration, on an enlarged scale and partially cutaway, of the forward entrance of the vehicle of FIGS. 1 and 2 viewed from arrow V3A of FIG. 1.
Figure 4:
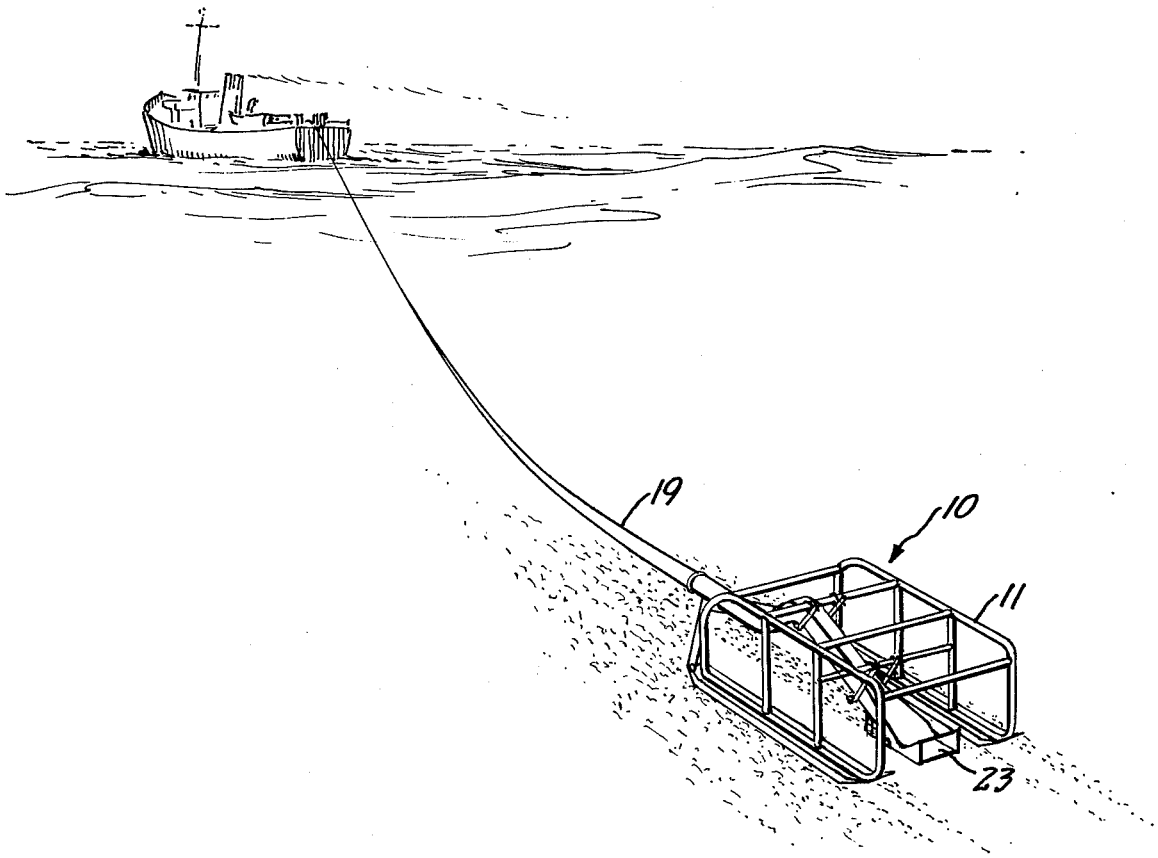
FIG. 4 is a perspective illustration of the vehicle and apparatus of FIGS. 1 and 2 deployed for undersea mining in conjunction with a surface ship.

Referring now to the drawing, FIGS. 1 to 4 depict vehicle 10 having rollbar and support framework 11 mounted on sliding runners 12 with pavement rider 13 and bumper 14. When the vehicle is moved over a sea floorline, depicted at 15 with siltline **15*a* above, indentation 16 at the lower edge of the bumper provides passage space 17 for moderate sizes of solids. Conveyance duct 18 is bound to the vehicle sufficiently to enable towing the vehicle with an attachment to the conveyance duct, for instance, suction transport riser 19 depicted with a flexible connection to the forward, exit, end of the conveyance duct. The aft, entrance, end of the duct is connected to transition tail pipe 20.**

The conveyance duct is of circular cross-section at the front and blends at **18*a*** to a rectangular cross section that is smoothly tapered to a greater width toward the aft connection with the tail pipe. The cross sectional area of the duct is constant throughout the length from entrance to exit, including the tapered aft portion.

The framework 11 supports the tail pipe 20 at a height where tail pipe baseplate 21 is at the level of bottom surfaces 22 of the sliding runners 12. The pipe 20 has aft-facing water entrance 23, forward-facing solids entrance 24, throat 25 and transition exit port 26. The pipe 20 is fabricated of metal plate, and the interior cross-sections are generally rectangular, possibly with filleted corners. The baseplate 21 forms a continuous floor under the solids entrance 24, the throat 25 and the water entrance 23 and the forward edge of the plate 21 forms the forward edge of the solids entrance 24, which is rectangular. Downward sloping rejection teeth 27 are adapted to bar entry of oversize solids and to force oversize solids down below the entrance 21. Also, the sloping teeth 27 can aid in overriding large obstacles, e.g., large pieces of pavement or rock. In relative cross-sectional area, the throat 25 is equal to the conveyance duct 18, the water entry 23 is greater, and the solids entry 24 is lesser.

Compaction plate 28 is mounted to the bottom of the duct 18 and supports side screens 29. The runners 12 are adapted, according to the characteristics of the sea bottom, to ride with the bottom surfaces of the runners 22 on relatively firm floorline material below soft above-floorline material, which at some places contains desired aggregates. The compaction plate 28 and side screens 29 are adapted to direct above-floor aggregates into the solids entrance 24.

Forward of the tail pipe 20, the duct 18 leads up and down through elevated elbow 30 and has elevated water gate 31, with remote control actuator 32. The elevated water gate 31 is a desirable feature which provides a controllable means for drawing clear, relatively free from sea floor material, water into the riser 19 and duct 18 when desired for special circumstances, e.g., during start-up of riser pumps, or flushing the duct 18 or when the vehicle 10 is moved through unusally turbid water. Remote control can be by communication, e.g., electric or acoustic, from a surface ship.

In use, the tail pipe 20 moves forward along the sea floorline 15 and the forward edges of the solids entrance 24 separate above-floorline solids from the floor; meanwhile, a forward flow of water induced by suction from the conveyance duct 18 is drawn into the aft entrance 23, through the throat 25, and forwardly upward into the exit port 26 and thence through the conveyance duct 18. As the pipe 20 moves forward, the taking of solids into the entrance 24 continues and the water flow in the pipe 20 is brought over the solids and moves the solids up through the exit port 26 and into the duct 18, from which the solids can be transmitted to a riser or other desired receiver.

The aft entrance 23 to the pipe 20 has a transverse cross-sectional area that is larger, e.g., 2 to 3 times larger, than the interior cross-section of the conveyance duct 18 and provides for the water velocity at the aft entrance being slower than the conduit water velocity in the conveyance duct, The interior cross-sectional area of the tail pipe 20 is reduced at the throat 25, between the aft entrance 23 (for water) and the forward entrance 24 (for solids), to an area equal to the cross-section of the conveyance duct 18. The floor 21 of the water entrance 23 and the solids entrance 24 are coextensive. The pipe 20 can be made of metal and/or other materials, e.g., plastics. Between the throat 25 and the solids entrance 24, the pipe 20 has a forwardly and upwardly directed port 26 that leads into the conveyance duct 18. Thus, water flow is forward from the aft entrance 23, through the throat 25 and up into the conveyance duct 18, while solids flow into the forward entrance 24 and up into the conveyance duct. The water flow rate depends upon the suction from the riser conduit connected to the conveyance duct. For instance, the water flow rate can be changed by changing of the speed of riser suction pumps. The solids flow rate depends upon the forward speed of the tail pipe 20 and may, for, instance, be changed by changing the speed of towing the vehicle 10. Desirably, the water flow through the pipe 20 conveys the solids up into the conveyance duct 18 before the solids reach the throat 25. However, if, undesirably, a build-up of solids commences in the throat 25, the water velocity in the throat

25 will be increased due to the reduction of the open cross-sectional area in the throat 25, and the increased water velocity will provide erosive capability for clearing the throat 25. In this respect, the tail pipe 20 has self-regulating capability for maintaining the water passage open without requiring changing the pumping or towing speed.

Advantageously, the exit port 26 or the exit portconveyance duct junction is at an angle of about 5° to 45°, or possibly 60°, e.g., 15° or 30°, forwardly upward from the horizontal in the direction of forward movement of the pipe 20. Also, of advantage, the forward entrance 24, throat 25 and aft entrance 23 are longitudinally aligned with the direction of forward movement, the baseplate 21 is flat and held parallel to the bottom surfaces 22 of the runners 12, and the cross-sectional area of the solids entrance 24 is about ½ to ¾ times the cross-sectional area of the conveyance duct 18.

In addition to transmitting solids that are naturally located at or above the floorline, the tail pipe can take in and transmit solids that have been windrowed, deposited or otherwise grouped together above the floorline by other apparatus that has acted ahead of the present tail pipe transition. For instance, the tail pipe transmitter can follow undersea raking or sweeping apparatus.

Some concentration of the desirably sized aggregates in the sea floor mixture is accomplished with elimination of oversize objects by the rejection teeth 27 and with some fines eliminated outward through side screens 29 by downward pressure from the compaction plate 28 in sea floor areas having relatively large amounts of soft overburden. Yet, when the compaction plate 28 is provided, the compaction plate is adapted to avoid tight dense compaction inasmuch as excessive compaction would be detrimental to good flow of solids through the pipe and ductwork.

When the pipe 20 is moved forward without suction from the conduit, such as when being moved while the clear water entrance 23 is open or when suction pumps are shut off, and thus when water is not being drawn forward through the throat 25, solids can pass rearwardly through the throat and be discharged out the aft opening of the pipe 20. A flat baseplate 21 floor in the pipe is advantageous for facilitating straight-through passage.

If desired, two inverted mirror-image embodiments of a tail pipe vehicle of the invention can be mounted with one inverted on top of the other and with the tail pipe exit ports connected in common to one conveyance duct, or portion thereof, to thereby provide capability for the vehicle to function satisfactorily when either tail pipe entrance lands on the sea bottom.

The present invention is applicable in the collection, concentration and transmission, to the sea surface or other desired location, of undersea mineral aggregates, particularly including manganese nodules. The transition chamber of the invention, including tail pipe embodiments thereof, is applicable for use in the primary separation of mineral aggregates from the sea floor and also for use in cooperation with other apparatus that initially moves, windrows or groups desired mineral aggregates or other desired solids.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. In an undersea mining apparatus having a hydraulic suction conveyance duct and means for enabling moving the duct in a forward direction over the undersea floorline in the mining locale of an undersea floor area where desired mineral aggregates are dispersed at the bottom of the sea, said duct being adapted to transmit a mixture of liquids and solids by hydraulic suction flow from the duct entrance to the duct exit at a desired location, the improvement comprising in combination with the conveyance duct and the forward movement means, a liquid-solid flow transition chamber having a solids entrance, a water entrance, an exit port, and a throat portion, said chamber entrances and exit port being disposed with the solids entrance facing in the forward direction, with the water entrance facing aft, with the exit port above and longitudinally between the solids entrance and the water entrance and facing forwardly and upwardly and being joined to the entrance end of the conveyance duct and with the throat portion longitudinally between the water entrance and the exit port, the cross-sectional areas of said entrances and port being in corelationships to the cross-sectional area of the conveyance duct whereby the solids entrance area is less, the water entrance area is greater and the exit port area and throat area are equal to the conveyance duct area; and means to support the bottom of the solids entrance and the bottom of the water entrance at least as high as the undersea floorline when the conveyance duct and the chamber are moved forwardly over the undersea floorline.

2. Apparatus as set forth in claim 1 wherein the movement means and the support means comprise a pair of sliding runners extending in parallel forward directions and a framework mounted on the runners and adapted to support the chamber at a position where the bottom of the solids entrance is at or closely above the undersea floorline.

3. Apparatus as set forth in claim 1 wherein the solids entrance has barriers adapted to prevent entrance of undesirably large solids.

4. Apparatus as set forth in claim 1 wherein the solids entrance, the throat and the water entrance are in longitudinal alignment with the direction of forward movement.

5. Apparatus as set forth in claim 1 wherein the bottom of the chamber is a flat plate extending continuously from the bottom of the solids entrance to the bottom of the water entrance.

6. Apparatus as set forth in claim 1 wherein the conveyance duct has an elevated remotely controllable gate positioned to enable drawing clear water into the duct at a place in front of the chamber.

7. Apparatus as set forth in claim 1 whereon a compaction plate is mounted above and forward of the solids entrance in an upwardly and forwardly sloping position adapted for forcing above-floorline solids downward toward the solids entrance.

8. Apparatus as set forth in claim 1 wherein the cross-sectional area of the water entrance is at least two times the cross-sectional area of the conveyance duct.

9. Apparatus as set forth in claim 1 wherein the cross-sectional area of the solids entrance is about ½ to about ¾ times the cross-sectional area of the conveyance duct.

10. Apparatus as set forth in claim 1 wherein the exit port-conveyance duct junction is inclined at an angle of about 5° to about 60° forwardly upward from the horizontal in the direction of forward movement.

* * * * *